US005423949A

United States Patent [19]

Ilmarinen

[11] Patent Number: 5,423,949

[45] Date of Patent: Jun. 13, 1995

[54] SHOE FOR AN EXTENDED-NIP PRESS

[75] Inventor: Antti Ilmarinen, Jyväskylä , Finland

[73] Assignee: Valmet Paper Machinery, Inc., Helsinki, Finland

[21] Appl. No.: 172,585

[22] Filed: Dec. 23, 1993

[30] Foreign Application Priority Data

Dec. 30, 1992 [FI] Finland ..... 925943

[51] Int. Cl.[6] ..... D21F 3/02

[52] U.S. Cl. ..... 162/358.3; 162/361

[58] Field of Search ..... 162/358.3–358.5, 162/361, 205

[56] References Cited

U.S. PATENT DOCUMENTS 5,110,417 5/1992 Lehtonen et al. ..... 162/361
5,262,011 1/1993 Ilmarinen ..... 162/358.3

FOREIGN PATENT DOCUMENTS 2239268 6/1991 United Kingdom .
9117308 11/1991 WIPO .
9313263 7/1993 WIPO .

*Primary Examiner*—Karen M. Hastings
*Attorney, Agent, or Firm*—Steinberg, Raskin & Davidson

[57] ABSTRACT

A shoe in an extended-nip press arranged to be placed in a nip between a back-up roll and a belt-mantle roll inside the belt mantle. The shoe is pressed by an actuator, e.g., a cylinder device, towards the back-up roll, while the web/felt or felts is/are placed between the back-up roll and the belt mantle. The shoe has at least one chamber provided for hydraulic fluid into which a fluid is passed from a duct. The shoe has a first curved face, whose curve radius is substantially equal to the curve form of the back-up roll. The shoe has a second face which forms the bottom of the chamber provided for hydraulic fluid. The second face joins the first face and has a larger curve radius than the first face. At a joint between the first face and the second face, the tangents of the faces are substantially the same.

16 Claims, 4 Drawing Sheets

SHOE FOR AN EXTENDED-NIP PRESS

BACKGROUND OF THE INVENTION

The present invention relates to a shoe in an extended-nip press of the type, e.g., present in paper machines. The present invention also relates to a method for using the shoe in an extended-nip press to obtain a desired pressure profile, usually a linear profile.

The optimal shape of the pressure curve in an extended-nip press is triangular, i.e., the pressure rises in a linear manner from zero to a maximum value. In prior art shoes for extended-nip presses, the rise of pressure has been unsatisfactory.

OBJECTS AND SUMMARY OF THE INVENTION

It is an object of the present invention to provide a new and improved shoe for an extended-nip press by whose means it is possible to come closer to the optimal triangular shape of the increase in pressure for the pressure curve.

In accordance with the present invention, the novel shoe has a first face in the area of the trailing side, when considered in the direction of running of the web. The radius $R_1$ of the first face corresponds to the curve radius of the back-up roll. The first face is followed by a second face which is also curved and which determines the shape of the bottom of the hydrostatic chamber. The second face is constructed having a radius $R_2$. At the joint between the first face and the second face, the radii $R_1$ and $R_2$ are situated on the same line, while the radius $R_2$ is slightly longer than the radius $R_1$. In relation to the hydrostatic chamber, the area at the inlet side of the chamber comprises a third face which has the same curve radius $R_1$ as the first face on the shoe, i.e., the third face corresponds to the curve form of the backup roll K. In the present invention, at the joint between the first face and the second face, the tangents of the faces are the same. As a result of this construction, in an arrangement in accordance with the present invention, a substantially linear, triangular curve of pressure increase is obtained. This type of curve provides substantial advantageous over the prior art devices.

The manufacture of a shoe in accordance with the present invention takes place so that as a first step, the bottom part/parts of the hydrostatic chamber, i.e. hydrostatic pocket, are machined, e.g., or turned, to form a radius $R_2$ in the second face portion and form the partition walls of the hydro-static chamber/chambers with radius $R_1$. After this step, the face of the shoe proper, i.e., the first face and the third face, are machined to define radius $R_1$.

A shoe in accordance with the present invention for an extended-nip press is mainly characterized in that the shoe has a first curved face, whose radius of curvature is substantially equal to the curve form of the back-up roll. The shoe has a second face which forms the bottom of the chamber provided for hydraulic fluid. The second face joins the first face and is constructed with a larger curve radius than the first face and so that, at the joint between the first face and the second face, the tangents of the faces are substantially the same.

The shoe in accordance with the present invention is placed in an extended-nip press wherein a nip is defined by a back-up roll and a belt-mantle roll. The shoe, in an interior of the belt mantle, is pressed by actuator means towards the back-up roll while a web runs on at least one felt between the back-up roll and the belt mantle. The shoe has at least one chamber in the second face portion for a lubricant, e.g., pressurized or hydraulic fluid. Further, the shoe may include a third face portion situated in an inlet side of the shoe at which the web enters the nip. The third face portion has a radius of curvature substantially equal to the radius of curvature of the first face portion, i.e., the radius of the back-up roll. The web is pressed between two corresponding surfaces having the same curvature, i.e., between the back-up roll and the first and third face portions. A planar face portion may be arranged in a direction substantially tangential to the third face portion and preceding the third face portion at the inlet side of the shoe, i.e., in the running direction of the web through the nip.

The shoe preferably includes a plurality of chambers arranged in a direction of width of the web and partition walls to separate the chambers from one another. Top edges of the partition walls have a shape corresponding to the radius of curvature of the first face portion so that in the area of the partition walls, the shoe has a uniform, curved surface corresponding to the curvature of the back-up roll.

In a preferred embodiment, the shoe has at least three interconnected parts. The first part constitutes the second face portion and forms a bottom of the chambers. The second and third part are arranged adjacent to the first part and constitute the first face portion and the third face portion which have a radius of curvature substantially equal to that of the back-up roll.

The present invention also relates to a method for providing a substantially linear pressure increase in a shoe of an extended-nip press. In the method, a back-up roll and a belt-mantle roll are arranged to define a nip through which a web runs on at least one felt. A shoe, in accordance with the present invention, is an interior of the belt mantle of the belt-mantle roll and is pressed against the back-up roll. As such, a first curved face portion in the shoe has a radius of curvature substantially equal to the curvature of the back-up roll, and a second curved face portion of the shoe, adjacent to the first face portion, has a chamber therein and a radius of curvature larger than the radius of curvature of the first face portion. By passing a pressurized fluid to the chamber through ducts, the shoe is loaded to provide a desired pressure profile, which is ideally a linear pressure profile.

Also, the first and second face portions may be arranged so that tangent lines to the first and second face portions are substantially the same at a joint between them. A third face portion of the shoe may be arranged at an inlet side of the shoe at which the web enters the nip. The third face portion has a radius of curvature substantially equal to the radius of curvature of the first face portion, i.e., the back-up roll. A plurality of chambers are arranged in a direction of width of the web and separated by partition walls.

In the following, the invention will be described with reference to some preferred embodiments of the invention illustrated in the figures in the accompanying drawings. However, the invention is not confined to these embodiments alone.

BRIEF DESCRIPTION OF THE DRAWINGS

The following drawings are illustrative of embodiments of the invention and are not meant to limit the scope of the invention as encompassed by the claims.

FIGS. 4A and 4B show pressure curves related to a shoe in accordance with the present invention for use in an extended-nip press over the distance of the length of the shoe, wherein FIG. 4A shows a shoe whose overall length is about 250 mm, and FIG. 4B shows a shoe whose overall length is about 150 mm.

DETAILED DESCRIPTION OF THE INVENTION

Figure 1:
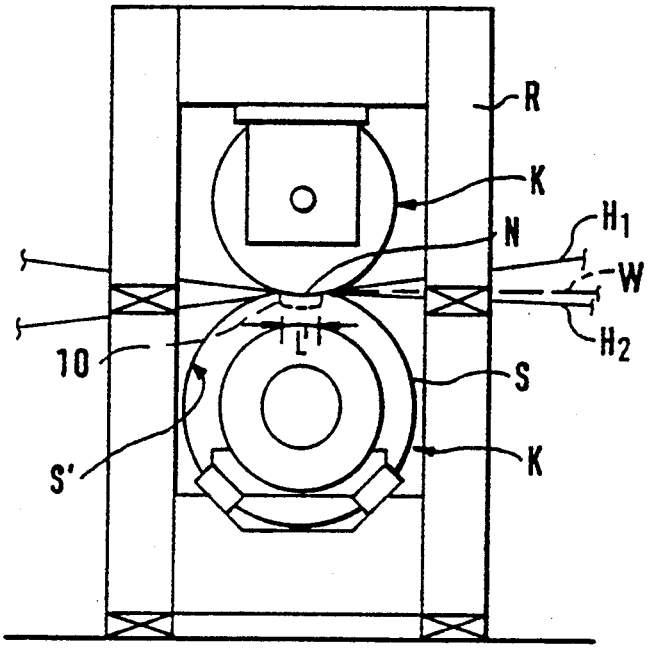
FIG. 1 is a side view of a prior art extended-nip press.

FIG. 1 is a side view of a prior art extended-nip press. Press felts $H_1$ and $H_2$ are passed through a nip N while a web W is placed in the middle of the felt draw. The nip N is formed between the rolls mounted on the frame R, e.g., a back-up roll $K_1$ and a belt-mantle roll $K_2$. A shoe 10 in accordance with the present invention may be placed in the extended-nip press inside the belt mantle S so that it is pressed against the felt-mantle face S'. Thus, an area L of the nip N becomes substantially long as the resilient belt mantle S follows the curve form and the surface form of the back-up roll $K_1$ over the entire length L of the shoe 10.

Figure 2:
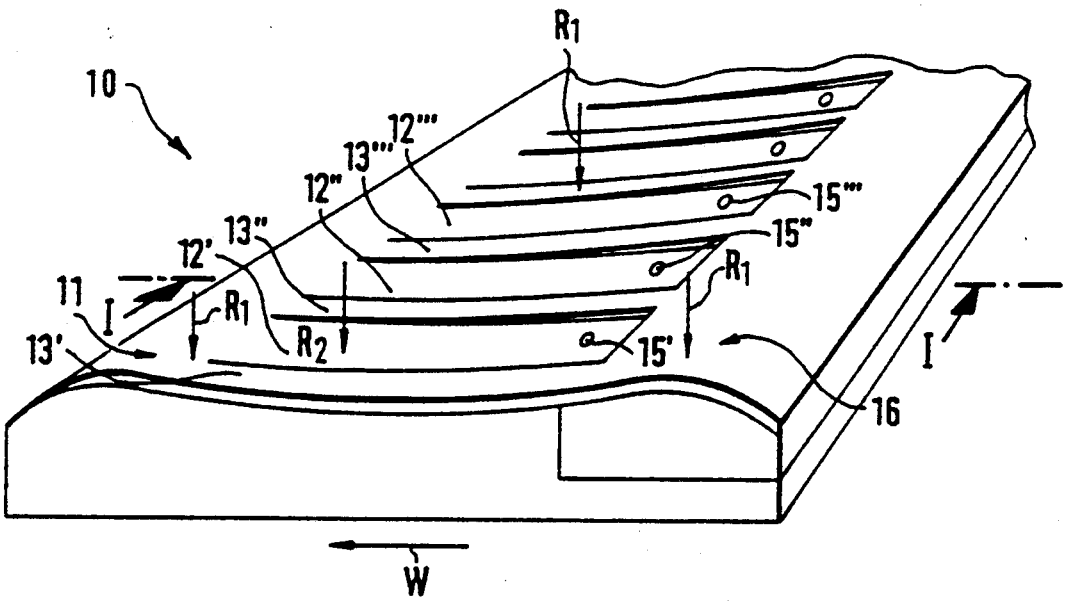
FIG. 2 is an axonometric view of a shoe in accordance with the present invention for use in an extended-nip press.
Figure 3:
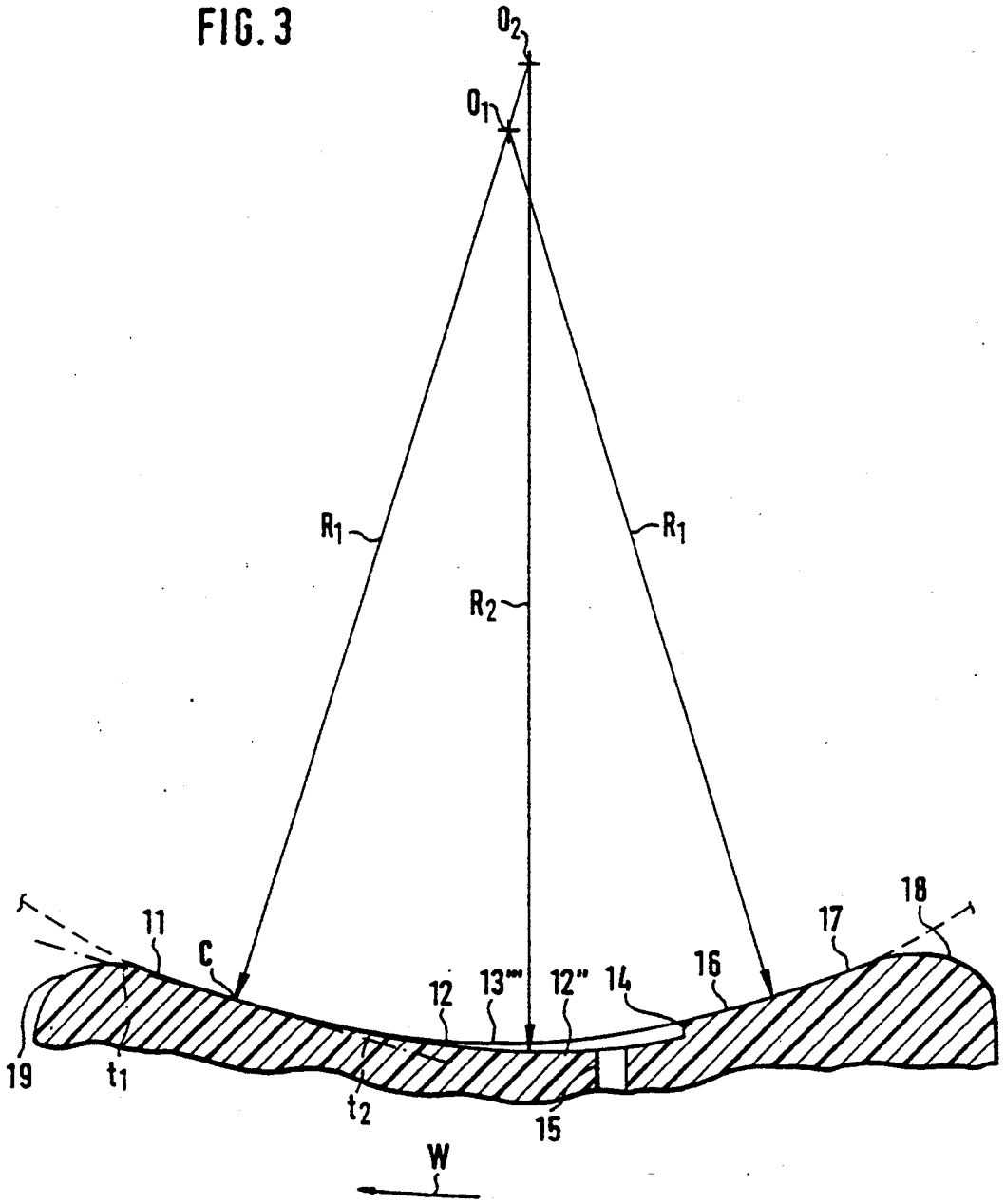
FIG. 3 is a sectional view taken along the line I—I in FIG. 2.

FIGS. 2 and 3 show a shoe 10 in accordance with the present invention for use in an extended-nip press. The shoe 10 has a first face 11 whose curve form $R_1$ corresponds to the radius, i.e., the curve form, of the back-up roll $K_1$. The shoe 10 has a second face 12 which forms the bottom of hydrostatic pockets or chambers 12',12'', 12'''. The hydrostatic pockets 12',12'' . . . define a hydrostatic space for pressure fluid. The face 12 is shaped to conform to the curve radius $R_2$. At a joint C between face 11 and face 12, the tangents $t_1$ and $t_2$ of the two faces 11 and 12 are the same. In addition to the curved bottom 12 and by an end wall 14, the hydrostatic chambers 12',12'' . . . are also defined by partition walls 13',13'' . . . arranged substantially in the transverse direction of the web.

The top edges of the partition walls 13',13'' . . . have a curvature corresponding to the curve radius $R_1$, which corresponds to the curve form of the back-up roll $K_1$. One or more ducts 15', 15'',15''' open into each of the chambers 12',12'' . . . , in order to pass pressurized fluid into the chambers 12',12'',12'''. The center of curvature of the top edge of the partition walls 13',13'' . . . is denoted by $O_1$ which is the same as that of face 11 and a third face 16.

The function of the partition walls 13',13'',13''' . . . is to operate as limiting means, or parts, which permit a maximum uniform distribution of the hydrostatic pressure across the length of the shoe without causing detrimental effects of outside interfering factors and impulses on the pressure formation. By means of the vertical end wall 14, the face 12 is joined by the third face 16 which has a curvature corresponding to the same curve radius $R_1$ as the back-up roll $K_1$.

FIG. 3 is a sectional view taken along the line I—I in FIG. 2. With reference to this figure, the shoe in accordance with the present invention is described in greater detail. The first face 11 joins the second curved face 12 smoothly at the point C. At the point C, the tangent $t_1$ of the face 11 is the same as the tangent $t_2$ of the face 12. Thus, when the radii $R_1$ and $R_2$ related to the point C are examined, the centers of curvature $O_1$ and $O_2$ of the faces 11 and 12 are placed on the same straight line which intersects with point C. The radius $R_2$ of the face 12 is slightly longer, and larger as shown, than the curve radius $R_1$ of the face 11. The ratio $R_2/R_1$, i.e., the ratio of the radii of curvature, is preferably in a range from about 1.05 to about 1.5 and even more advantageously in a range from about 1.1 to about 1.3.

During construction of the shoe 10, the adjustable variables are the length $L_1$ of the first face 11, the length $L_2$ of the second face 12, and, in the inlet area of the web W into the shoe, the length $L_3$ of the face 16 and the length $L_4$ of face 17 in the lateral area. The face 17 is preferably a straight planar face that is connected to the radius $R_1$ substantially tangentially. Further, the shoe 10 comprises an initial rounding, or rounded portion, 18 arranged before face 17 in the running direction of the web and a final rounding 19 arranged after face 11 in the running direction of the web. The overall length (L) of the shoe is $L=L_1+L_2+L_3+L_4$.

A particularly advantageous form of the pressure curve in the shoe in accordance with the present invention is obtained with a construction in which the ratio of radii $R_2/R_1$ is as small as possible, preferably in a range from about 1.1 to about 1.3, and wherein the length $L_2$ of the hydrostatic chamber 13 is as large as possible. Also, preferably the face 11 in the area of the trailing edge of the shoe is relatively short and, in an extreme case, may be omitted entirely. The overall length of the shoe 10 is preferably in a range from about 120 mm to about 150 mm.

Figure 4A:
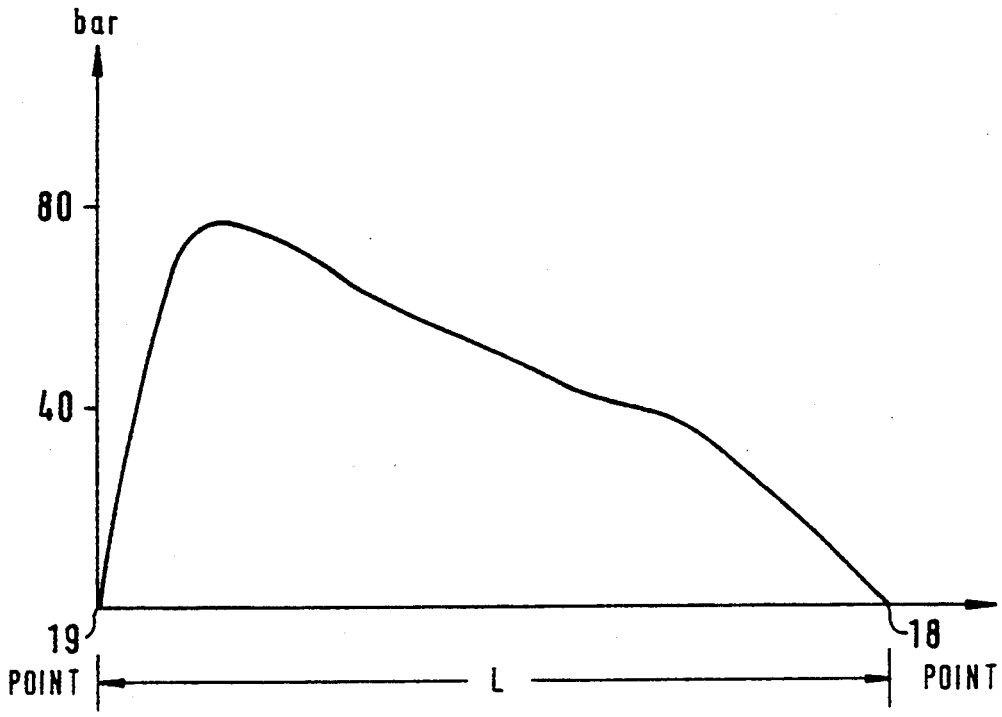
Figure 4B:
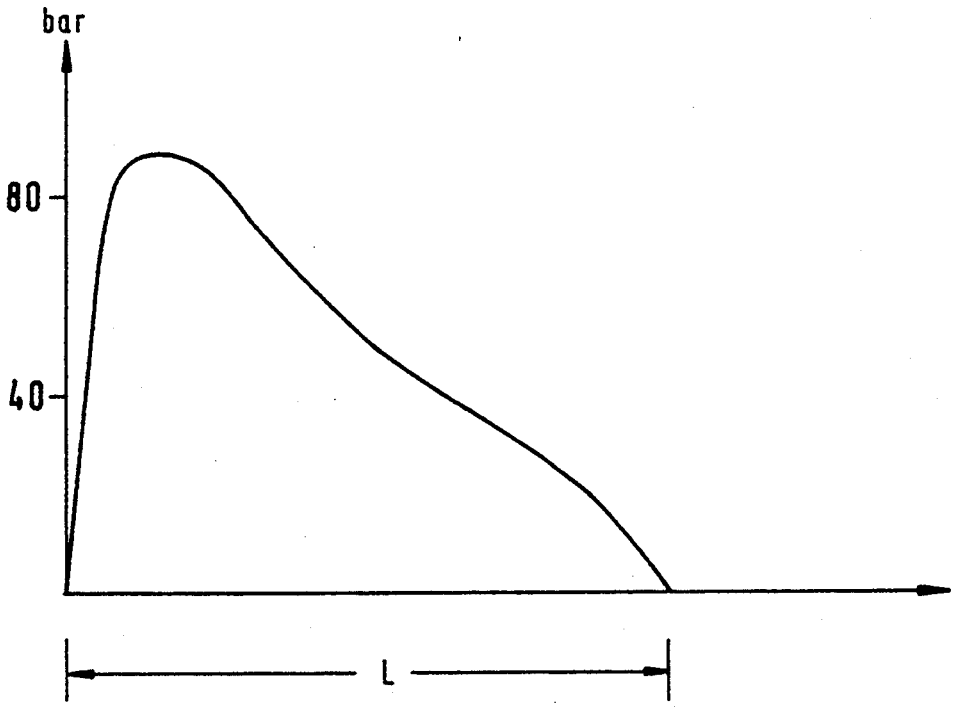

FIG. 4A shows the formation of the pressure curve from the initial rounding 18 to the final rounding 19 in an embodiment in which the overall length L of the shoe is about 250 mm. FIG. 4B shows the formation of the pressure curve in an embodiment in which the overall length L of the shoe is about 150 mm. From FIGS. 4A and 4B, it is seen that the rise of the pressure curve is substantially linear, and, in a corresponding manner, the lowering or decrease of the pressure curve is as steep as possible.

Figure 5:
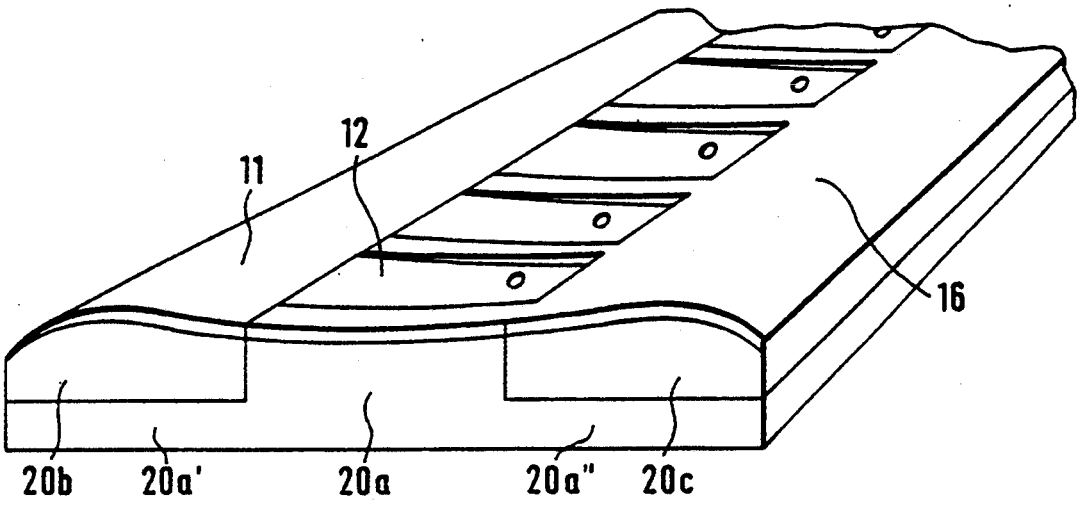
FIG. 5 shows the composition of a shoe in accordance with the present invention.

FIG. 5 shows a mode of construction and formation of the shoe in accordance with the present invention. The bottom parts 12 of the hydrostatic pockets 12',12'',12''' are first turned, or machined, so that they have a radius $R_2$, and thereafter, the partition walls 13',13'',13''' are turned with the radius $R_1$. The faces 11 and 16 of lateral parts **20*b*,20*c* are turned with the radius $R_1$. The parts 20*b*,20*c* are fixed, for example by means of screws, to the middle part 20*a* of the construction, e.g., to its side projections 20*a*',20*a*''. The middle part 20*a* includes the hydrostatic chambers 12', 12'', 12'''**.

Figure 6:
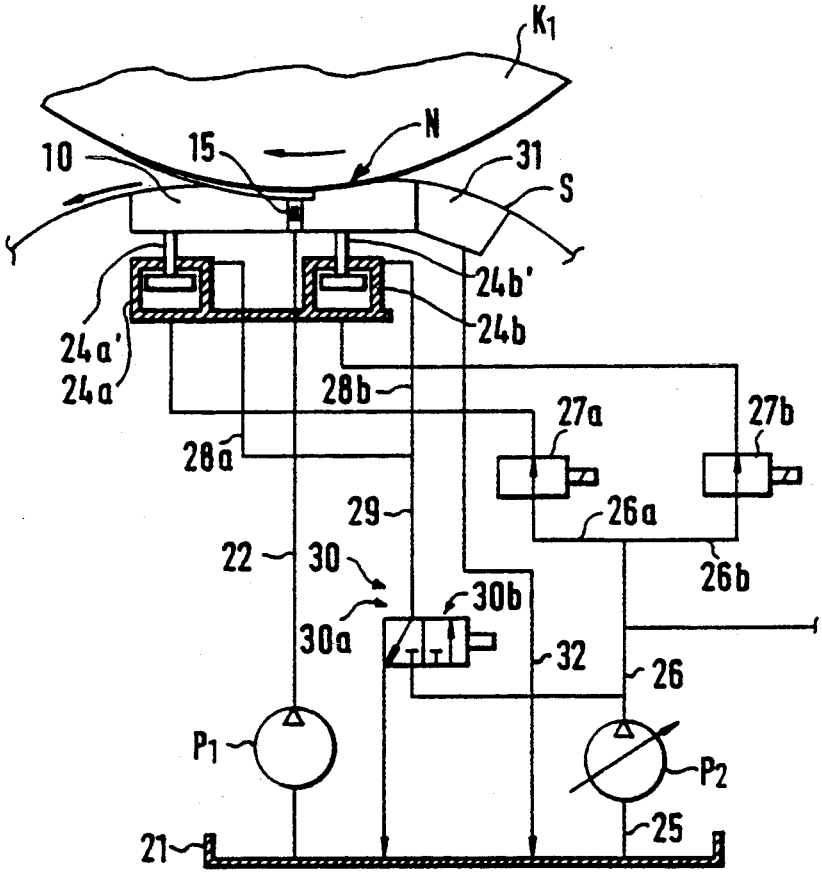
FIG. 6 shows a hydraulic diagram related to a hydrostatic shoe.

FIG. 6 shows a hydraulic diagram of a hydrostatic loading shoe 10 in accordance with the present invention. A lubricant, preferably hydraulic fluid, is passed from the fluid container 21 by means of a fluid pump P, along a duct 22 into a capillary duct 15/ducts 15', 15'' . . . in the shoe 10 as shown in FIG. 2. Through the capillary duct 15/ducts 15', 15'', 15''' . . . the fluid flows through the face 12 into the chambers 12', 12''. . .

The shoe 10 is loaded hydraulically by loading means, e.g., cylinder devices 24*a*, 24*b*, by means of their pistons 24*a*, 24*b*, in relation to the length of the hydrostatic shoe 10, from both ends of the shoe 10. The hydraulic cylinders 24*a*,24*b* can be loaded independently from one another, and in this manner, it is possible to vary the loading of the shoe so as to obtain a desired pressure curve.

The pressurized fluid is passed from the fluid container 21, from the duct 25, by means of a regulation pump $P_2$ into the duct 26 and further into the ducts 26*a*,26*b*. Ducts 26*a*,26*b* may include proportionally adjustable valves 27*a*,27*b*, or other compatible regulation means, to regulate the loads applied by the pistons 24*a*,24*b*. The return ducts 28*a*,28*b* from the cylinder 24*a*,24*b* are connected with the duct 29 which comprises a valve 30. When the block 30*a* of the valve 30 is switched on, the fluid flow passes through the valve 30 into the hydraulic-fluid container 21. When the block 30*b* of the regulation valve 30 is switched on, the flow is passed from the pump $P_2$ into the cylinders 24*a*,24*b* and into the cylinder spaces at the side of the piston rod. As shown in FIG. 6, the overflow of the fluid is passed from the overflow space 31 along the duct 32 into the fluid container 21.

The examples provided above are not meant to be exclusive. Many other variations of the present invention would be obvious to those skilled in the art, and are contemplated to be within the scope of the appended claims.

I claim:

1. A shoe in an extended-nip press, which shoe is positionable in a nip between a back-up roll and a belt-mantle roll in an interior of the belt mantle, the shoe being pressed by actuator means towards the back-up roll while a web runs on at least one felt between the back-up roll and the belt mantle, the shoe having at least one chamber for a pressurized fluid, said shoe having a first curved face portion and a second curved face portion arranged adjacent to said first face portion and preceding said first face portion in a running direction of the web, said first face portion having a radius of curvature substantially equal to the curvature of the back-up roll, said second face portion forming a bottom of the chamber and having a radius of curvature larger than the radius of curvature of said first face portion, said first face portion and said second face portion being arranged such that said first and second face portions have substantially the same tangent lines at a joint therebetween.

2. The shoe of claim 1, wherein the shoe further has a third face portion situated at an inlet side of the shoe at which the web enters the nip and preceding said second face portion in the running direction of the web, said third face portion having a radius of curvature substantially equal to the radius of curvature of said first face portion.

3. The shoe of claim 2, wherein the shoe has a planar face portion arranged substantially tangential to said third face portion and preceding said third face portion at the inlet side of the shoe.

4. The shoe of claim 3, wherein the shoe has an initial rounded portion arranged before said planar face in a running direction of the web, and a final rounded portion arranged after said first face portion in the running direction of the web.

5. The shoe of claim 2, wherein the shoe comprises at least three interconnected parts, a first part comprising said second face portion and forming a bottom of the chamber, a second and third part being arranged at sides of said first part and comprising said first face portion and said third face portion, respectively.

6. The shoe of claim 2, wherein a vertical step is defined between said third face portion and said second face portion, said step defining in part said at least one chamber.

7. The shoe of claim 1, wherein the ratio of the radius of curvature of said first face portion to the radius of curvature of said second face portion is in a range from about 1.05 to about 1.5.

8. The shoe of claim 1, wherein the ratio of the radius of curvature of said first face portion to the radius of curvature of said second face portion is in a range from about 1.1 to about 1.3.

9. The shoe of claim 1, wherein said at least one chamber comprises a plurality of chambers arranged in a direction of width of the web and partition walls to separate said plurality of chambers from one another, top edges of said partition walls having a curved form corresponding to the radius of curvature of said first face portion.

10. The shoe of claim 9, further comprising a plurality of ducts for passing hydraulic fluid to said chambers, at least one of said ducts being connected to a bottom of each of said plurality of chambers.

11. The shoe of claim 9, wherein said plurality of chambers are further defined by a vertical end wall situated between said third face portion and said second face portion.

12. The shoe of claim 1, wherein the length of the shoe is from about 120 mm to about 150 mm.

13. A shoe in an extended-nip press, which shoe is positionable in a nip between a back-up roll and a belt-mantle roll in an interior of the belt mantle, the shoe being pressed by actuator means towards the back-up roll while a web runs on at least one felt between the back-up roll and the belt mantle, the shoe having at least one chamber for a pressurized fluid, comprising a first part having a first curved face portion, said first face portion having a radius of curvature substantially equal to the curvature of the back-up roll, a second part having a second curved face portion arranged adjacent to said first face portion and preceding said first face portion in a running direction of the web, said second face portion having a radius of curvature larger than the radius of curvature of said first face portion, said first part and said second part being arranged such that said first and second face portions have substantially the same tangent lines at a joint therebetween, and a third part arranged adjacent to said first part such that said second part is situated between said first part and said third part, said third part having a third face portion situated in an inlet side of the shoe at which the web enters the nip, said third face portion having a radius of curvature substantially equal to the radius of curvature of said first face portion.

14. A method for providing a desired pressure increase in a shoe of an extended-nip press, comprising the steps of:

arranging a back-up roll and a belt-mantle roll to define a nip through which a web runs on at least one felt, arranging a shoe in an interior of the belt mantle of the belt-mantle roll, pressing the shoe against the back-up roll, providing a first curved face portion in the shoe having a radius of curvature substantially equal to the curvature of the back-up roll, arranging a second curved face portion in the shoe adjacent to the first face portion and preceding the first face portion in a running direction of the web such that tangent lines to the first and second face portions are substantially the same at a joint therebetween, the second face portion having at least one chamber therein and having a radius of curvature larger than the radius of curvature of the first face portion, and passing a pressurized fluid to the at least one chamber through ducts to load the shoe and provide a desired pressure profile.

15. The method of claim 14, further comprising arranging a third face portion of the shoe at an inlet side of the shoe at which the web enters the nip and preceding said second face portion in the running direction of the web, the third face portion having a radius of curvature substantially equal to the radius of curvature of the first face portion.

16. The method of claim 14, wherein the at least one chamber comprises a plurality of chambers, further comprising the steps of positioning the plurality of chambers in a direction of width of the web and separating the chambers by partition walls.

* * * * *